US006759919B2

(12) United States Patent
Barry et al.

(10) Patent No.: US 6,759,919 B2
(45) Date of Patent: Jul. 6, 2004

(54) LOW INTERMODULATION FILM MICROWAVE TERMINATION

(75) Inventors: Richard L. Barry, Attleboro, MA (US); Ronald Schmidt, Middleboro, MA (US)

(73) Assignee: Barry Industries, Inc., Attleboro, MA (US)

( * ) Notice: Subject to any disclaimer, the term of this patent is extended or adjusted under 35 U.S.C. 154(b) by 0 days.

(21) Appl. No.: 10/361,392

(22) Filed: Feb. 10, 2003

(65) Prior Publication Data

US 2003/0117225 A1 Jun. 26, 2003

Related U.S. Application Data

(63) Continuation of application No. 10/310,518, filed on Dec. 5, 2002, now abandoned.
(60) Provisional application No. 60/337,593, filed on Dec. 5, 2001.

(51) Int. Cl.[7] ..... H01P 1/26
(52) U.S. Cl. ..... 333/22 R; 333/32
(58) Field of Search ..... 333/22 R, 32

(56) References Cited

U.S. PATENT DOCUMENTS 4,647,877 A * 3/1987 Thompson ..... 333/22 R
5,370,458 A 12/1994 Goff ..... 374/122
5,699,224 A * 12/1997 Hanamura et al. ..... 361/313
6,043,989 A * 3/2000 Hayakawa et al. ..... 361/800
6,501,352 B1 * 12/2002 Koriyama et al. ..... 333/260

FOREIGN PATENT DOCUMENTS

SU 0664250 * 5/1979

OTHER PUBLICATIONS

Barry www.barryind.com Product Catalog 2002, Barry Industries, Attleboro, MA.

* cited by examiner

*Primary Examiner*—Robert Pascal
*Assistant Examiner*—Stephen E. Jones
(74) *Attorney, Agent, or Firm*—Weingarten, Schurgin, Gagnebin & Lebovici LLP

(57) ABSTRACT

A film microwave termination device includes a substrate, such as a ceramic substrate, and multiple film resistors formed on the substrate. The film resistors each have a predetermined resistivity generally less than a desired characteristic impedance of the device. The resistors are connected together in series so as to (i) provide an overall impedance equal to the desired characteristic impedance, and (ii) generate less intermodulation distortion in microwave signals coupled to the termination device than would be generated by an alternative termination device employing a single film resistor whose resistivity is equal to the desired characteristic impedance. In a disclosed 50-ohm termination, four square elements are formed of thick-film material having resistivity of 12.5 ohms per square, and these four elements are connected in series on the substrate to realize the desired 50 ohm termination impedance. Thin-film resistors may also be employed.

13 Claims, 1 Drawing Sheet

LOW INTERMODULATION FILM MICROWAVE TERMINATION

CROSS REFERENCE TO RELATED APPLICATIONS

This application is a continuation under 35 U.S.C. ±120 of pending U.S. patent application Ser. No. 10/310,518 filed Dec. 5, 2002,now abandoned, which claims priority under 35 U.S.C. 5119(e) of U.S. Provisional Patent Application No. 60/337,593 filed Dec. 5, 2001, the disclosures of these applications being incorporated by reference herein.

STATEMENT REGARDING FEDERALLY SPONSORED RESEARCH OR DEVELOPMENT

Not Applicable

BACKGROUND OF THE INVENTION

The present invention relates to the field of film passive microwave devices such as passive terminations.

It has been known to make microwave terminations by forming a single film resistive element on a substrate such as ceramic. In the case of a 50-ohm termination, for example, a resistive element can take the form of a square of thick-film material having resistivity of 50 ohms per square. A square shape is often desirable for manufacturing reasons. It is therefore common to use a film material whose resistivity is exactly equal to the desired termination resistance, so that such material can be deposited in the desired square shape and provide the desired termination resistance.

When a non-sinusoidal microwave signal is applied to a film termination in an operating system, some degree of intermodulation distortion may be added to the signal by the device. Such intermodulation distortion arises from the non-linearity of the characteristics of the device with respect to the voltage of the applied signal. It is desired to minimize any such intermodulation distortion in an operating system.

BRIEF SUMMARY OF THE INVENTION

In accordance with the present invention, a film microwave termination is disclosed. The termination exhibits lower intermodulation distortion than typical prior art terminations formed from a single film resistive element.

The disclosed termination device includes a substrate, such as a ceramic substrate, and multiple film resistors formed on the substrate. The film resistors each have a predetermined resistivity generally less than a desired characteristic impedance of the device. The resistors are connected together in series so as to (i) provide an overall impedance equal to the desired characteristic impedance, and (ii) generate less intermodulation distortion in microwave signals coupled to the termination device than would be generated by an alternative termination device employing a single film resistor whose resistivity is equal to the desired characteristic impedance. In an illustrated embodiment for a 50-ohm termination, four square elements are formed of thick-film material having resistivity of 12.5 ohms per square, and these four elements are connected in series on the substrate to realize the desired 50 ohm termination impedance. Other common system impedances such as 12.5 or 100 ohms can be realized in a similar fashion using corresponding lower or higher resistivity material. Alternative embodiments may employ thin-film rather than thick-film material.

It is believed that the use of multiple elements of lower resistivity exhibits better linearity with respect to voltage, and therefore reduced intermodulation distortion, than exhibited by a traditional single-element termination. It is believed that this improved linearity arises from the lower sheet resistivity of the material used to make the resistors.

Other aspects, features, and advantages of the present invention will be apparent from the detailed description that follows.

BRIEF DESCRIPTION OF THE SEVERAL VIEWS OF THE DRAWING

The invention will be more fully understood by reference to the following Detailed Description of the Invention in conjunction with the Drawing, of which.

DETAILED DESCRIPTION OF THE INVENTION

Figure 1:
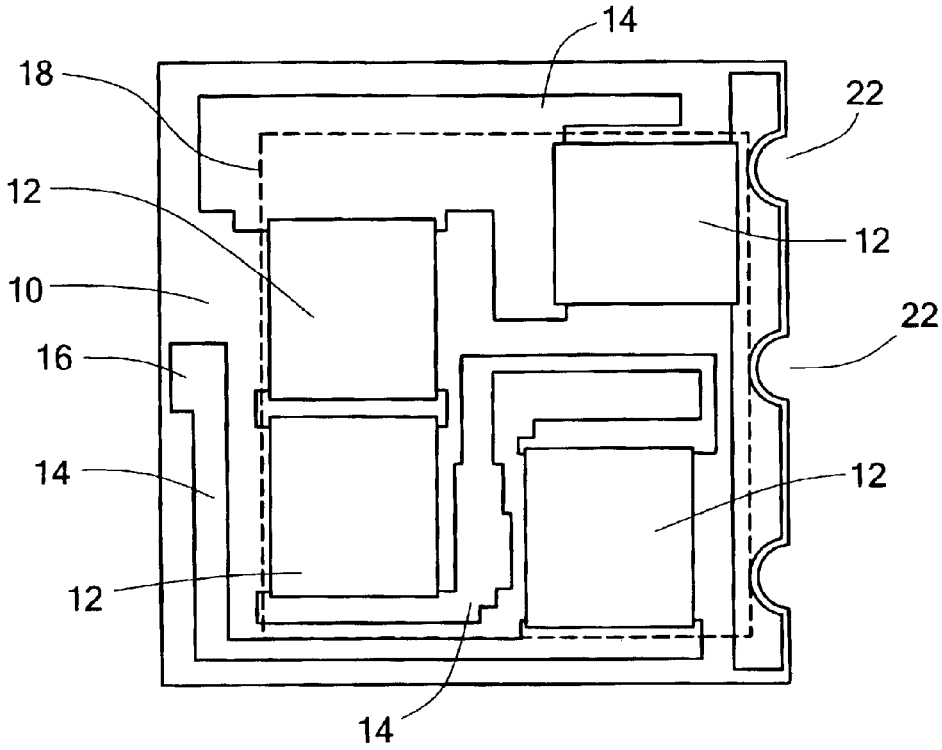
FIG. 1 is a top plan view of a low intermodulation thick film microwave termination in accordance with the present invention.

FIG. 1 shows a 50-ohm microwave termination device which includes a ceramic substrate 10 having a plurality of thick film resistors 12 on one surface thereof. The resistors 12 are interconnected by a pattern of conductors 14 in a manner providing an intended impedance at the microwave frequencies of interest. Techniques for laying out circuit elements in such a manner are generally known to those skilled in the art. Overall, the substrate 10 measures approximately 1 cm.×1 cm., and each resistor 12 measures approximately 2.5 mm.×2.5 mm. One terminal 16 of the device is provided on the top surface of the substrate 10. An insulative passivation layer 18 is preferably provided over the resistors 12.

Figure 2:
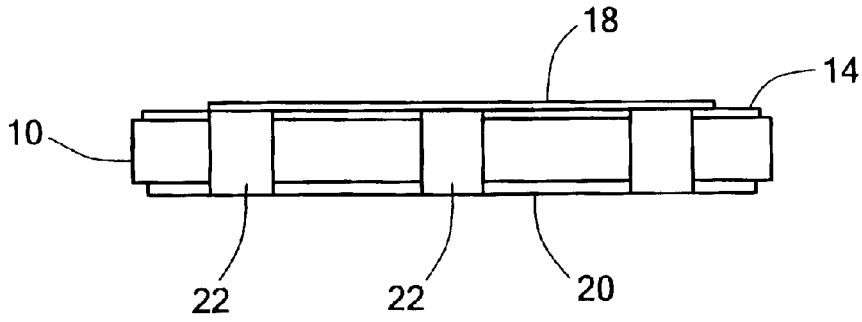
FIG. 2 is a side elevation view of the low intermodulation thick film microwave termination of FIG. 1.

As shown in FIG. 2, a conductive pad 20 which serves as the other terminal of the device is provided on the other planar surface of the substrate 10. It will be appreciated that the illustrated device is surface mountable, and that the pad 20 can be soldered directly to a separate circuit substrate on which the device is to be mounted. The pad 20 is connected to one of the string of resistors 12 (upper right in FIG. 1) via conductively-coated half-vias 22 at one edge of the device.

In alternative embodiments, the one terminal 16 may be replaced by a pad on the bottom of the device and one or more conductive half-vias in a fashion similar to the pad 20 and half vias 22. In such an embodiment, both the new pad and the pad 20 would lie on the bottom of the device, electrically isolated from one another, and both connections to the device would be via corresponding electrically conductive areas on the surface of the substrate to which the device is mounted. It will be appreciated that the device terminals can also be rearranged to facilitate other mounting or packaging schemes as may be desired.

In the illustrated embodiment, there are four resistors 12 connected in series to make a 50-ohm termination. The resistors 12 are made of a thick film of substantially lower sheet resistivity than is typically employed in prior 50-ohm terminations. In the illustrated termination device, a resistivity of 12.5 ohms per square is employed, which is substantially lower than the conventional 50 ohms per square of known devices. The lower sheet resistivity provides for substantially lower intermodulation distortion relative to a standard design which consists of a single resistor element to attain the desired 50 ohm value. In particular, it is believed that the improved intermodulation distortion is due to improved linearity of the device with respect to voltage, which in turn arises from the lower sheet resistivity of the material used to make the resistors 12.

Although the resistors 12 are square-shaped in the illustrated device, alternative embodiments may employ resistors of different shapes. The use of a square shape eases the design task, because the resistance of any square will be equal to the resistivity (in ohms/square units) of the thick film. If a non-square shape is employed, then the geometry of the resistor must also be considered in calculating the resistor's actual resistance.

Although the illustrated embodiment utilizes a thick film material to constitute the resistors 12, it will be appreciated that alternative embodiments can employ thin-film resistors instead. Thin films can be deposited in any of a variety of known manners, including sputtering. As a particular example, it is possible to create thin films with 12.5 ohms per square resistivity as in the illustrated thick-film embodiment, so that a thin-film version of the termination device can be constructed using the same layout for the resistors 12 as shown in FIG. 1. Other alternatives are of course possible.

It will be apparent to those skilled in the art that modifications to and variations of the disclosed methods and apparatus are possible without departing from the inventive concepts disclosed herein, and therefore the invention should not be viewed as limited except to the full scope and spirit of the appended claims.

What is claimed is:

1. A microwave termination device of a predetermined characteristic impedance, comprising;

a substrate; and a plurality of film resistors formed on the substrate, the film resistors each having a predetermined sheet resistivity substantially lees than the characteristic impedance per square and being connected together so as to (i) provide an overall impedance equal to the predetermined characteristic impedance, and (ii) generate less intermodulation distortion in microwave signals coupled to the termination device than would be generated by an alternative termination device employing a single film resistor having resistivity substantially equal to the predetermined characteristic impedance.

2. A microwave termination device according to claim 1, wherein the predetermined characteristic impedance is substantially 50 ohms.

3. A microwave termination device according to claim 2, wherein the film resistors are connected in series and the resistivity of each of the film resistors is substantially 12.5 ohms per square.

4. A microwave termination device according to claim 1, wherein the film resistors are connected in series.

5. A microwave termination device according to claim 1, wherein each of the film resistors is of substantially square shape.

6. A microwave termination device according to claim 1, wherein the film resistors are each formed of a thick-film material.

7. A microwave termination device according to claim 1, wherein the film resistors are each formed of a thin-film material.

8. A microwave termination device according to claim 1, wherein the substrate comprises ceramic.

9. A microwave termination device according to claim 1, being dimensioned and configured for mounting directly to an electrically conductive surface.

10. A microwave termination device according to claim 9, wherein (1) the substrate is a planar substrate, and (2) the film resistors are arranged on only one planar surface of the substrate.

11. A microwave termination device according to claim 10, wherein one terminal of the termination device comprises a conductive pad disposed on the other planar surface of the substrate.

12. A microwave termination device according to claim 11, further comprising a conductive half-via at one edge of the device connecting the conductive pad to one of the film resistors of the device.

13. A microwave termination device according to claim 10, further comprising a layer of passivation material on the one surface of the substrate for protection of the film resistors.

* * * * *

UNITED STATES PATENT AND TRADEMARK OFFICE

CERTIFICATE OF CORRECTION

PATENT NO. : 6,759,919 B2
DATED : July 6, 2004
INVENTOR(S) : Richard L. Barry et al.

It is certified that error appears in the above-identified patent and that said Letters Patent is hereby corrected as shown below:

Column 1,
Line 7, “is a continuation” should read -- claims priority --;
Line 7, “±120” should read -- §120 --;
Line 10, “5119 (e)” should read -- §119(e) --;
Line 10, “Dec. 5, 2001, the” should read -- Dec. 5, 2001, now abandoned, the --; and Column 3,
Line 35, “lees” should read -- less --.

Signed and Sealed this

Eighth Day of November, 2005

JON W. DUDAS
*Director of the United States Patent and Trademark Office*